US005370531A

United States Patent [19]

Tsurumi et al.

[11] Patent Number: 5,370,531

[45] Date of Patent: Dec. 6, 1994

[54] ATMOSPHERIC OVEN

[75] Inventors: Koichi Tsurumi, Neyagawa; Shinji Shimazaki, Nishinomiya; Koichi Kumagai, Ikoma, all of Japan

[73] Assignee: Matsushita Electric Industrial Co., Ltd., Osaka, Japan

[21] Appl. No.: 935,987

[22] Filed: Aug. 27, 1992

[51] Int. Cl.[5] ..... F27D 1/18

[52] U.S. Cl. ..... 432/242; 432/59; 432/128

[58] Field of Search ..... 432/59, 8, 121, 124, 432/128, 133, 146, 147, 167, 175, 242

[56] References Cited

U.S. PATENT DOCUMENTS

| | | | |
|---|---|---|---|
| 4,753,777 | 6/1988 | Yoshinari et al. | 432/59 |
| 4,790,749 | 12/1988 | Mauro | 432/59 |
| 5,172,849 | 12/1992 | Barten et al. | 432/242 |
| 5,193,996 | 3/1983 | Mullen | 432/59 |

*Primary Examiner*—Henry C. Yuen

*Attorney, Agent, or Firm*—Wenderoth, Lind & Ponack

[57] ABSTRACT

An atmospheric oven containing an atmospheric gas kept at a predetermined purity and accommodates a transporting means for transport an object to be heated along a predetermined transporting path. A includes a cylindrical portion for preventing the gas from flowing outside the oven, extends in a certain length from an entrance of the oven and an exit of the oven and has a sectional area necessary for passing the object through the portion.

5 Claims, 5 Drawing Sheets

ATMOSPHERIC OVEN

BACKGROUND OF THE INVENTION

The present invention relates to an atmospheric oven utilized as a reflow oven.

A conventional reflow oven is described below with reference to FIG. 11. An oven 131 is partitioned into a preheating chamber 132, a reflow chamber 133, and a slow-cooling chamber 134. A chain conveyor 135 for transporting a substrate extends through the chambers 132, 133, and 134. In addition, each chamber has a construction for introducing nitrogen gas thereinto, and heaters 136 are provided above and below the chain conveyor 135. In this manner, the substrate 120 is uniformly heated in an inactive atmosphere. A mechanical shutter 139 or an air curtain forming means is installed on an entrance 137 of the oven 131 and an exit 138 thereof to keep the nitrogen gas atmosphere in the oven 131 at an approximately constant purity.

As shown in FIG. 12, the oven 131 has a width so that a wide substrate is allowed to pass therethrough. The heater 136 has a width corresponding to the wide substrate, and the chain conveyor 135 comprises a pair of chain guides 135*a* and 135*b* movable widthwise or horizontally according to the width of the substrate as shown by an arrow of FIG. 12.

An opening/closing mechanism of the mechanical shutter 139, mounted on the entrance 137 of the oven 131 and the exit 138 thereof to prevent the nitrogen gas from flowing outside the oven, is complicated and, as such expensive. In addition, the opening and closing mechanism is ineffective if the interval at which the substrate is supplied to the oven is not large enough to close the mechanical shutter 139. If the air curtain forming means is installed on the entrance 137 and the exit 138 instead of the mechanical shutter 139, a large amount of nitrogen gas is consumed, and the running cost becomes high.

Further, since a oven 131 has the width corresponding to the widest substrate, the capacity of the oven 131 is great. Then, even if the size of the substrate is small, a large amount of nitrogen gas is consumed, because the capacity of the oven 131 cannot be reduced, and hence the running cost is high.

SUMMARY OF THE INVENTION

It is an object of the present invention to provide an atmospheric oven which is simple in its configuration and yet effectively prevents atmospheric gas from flowing out therefrom so that a small amount of atmospheric gas is consumed, the running cost is low, and the gas is kept at an approximately constant purity.

It is another object of the present invention to provide an atmospheric oven which is small in its volume so that the atmospheric gas is consumed in a small amount and the running cost is low.

It is still another object of the present invention to provide an atmospheric oven in which a predetermined temperature profile can be easily set.

In accomplishing these and other objects, according to one aspect of the present invention, there is provided an atmospheric oven containing atmospheric gas kept at a predetermined purity and accommodating a transporting means for transporting an object to be heated along a predetermined transporting path. The oven comprises a cylindrical portion for preventing the gas from flowing outside the oven extending in a certain length from one of an entrance of the oven and an exit thereof and having a sectional area necessary for passing the object through the portion.

According to the above construction, there are provided cylindrical portions extending from the entrance and the exit of the oven a certain length and having the smallest sectional area possible to pass therethrough the transporting means and the substrate placed thereon. Therefore, though simple in its construction, the oven is capable of preventing the gas from flowing outside in a large amount and consumes a small amount of the gas. The oven is effective in particular when the interval of the transporting path is narrow.

BRIEF DESCRIPTION OF THE DRAWINGS

The above and other objects and features of the present invention will become clear from the following description, taken in conjunction with preferred embodiments thereof and with reference to the accompanying drawings, in which.

DETAILED DESCRIPTION OF THE INVENTION

Figure 1:
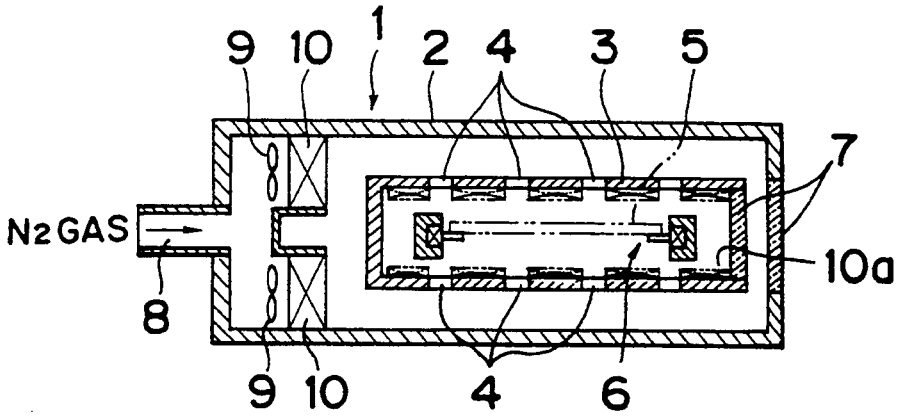
FIG. 1 is a cross-sectional view showing a reflow oven according to a first embodiment of the present invention.

Before the description of the present invention proceeds, it is to be noted that like parts are designated by like reference numerals throughout the accompanying drawings.

Figure 2:
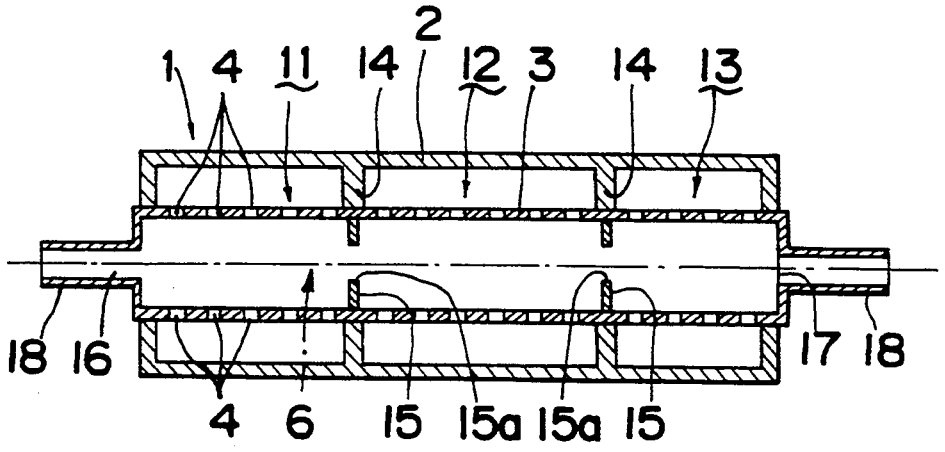
FIG. 2 is a vertical sectional view of the reflow oven of FIG. 1.

Referring to FIGS. 1 and 2, a fellow oven according to a first embodiment of the present invention will be described below.

A reflow oven 1 comprises an outer oven 2 that is rectangular and tunnel-shaped, and an inner oven 3 having the same configuration as the outer oven 2 and disposed inside the outer oven 2 and extending laterally the whole length of the outer oven 2. As shown in FIG. 1, the inner oven 3 is disposed from approximately the middle of the outer oven 2 to the forward portion thereof such that it is provided only on one side thereof. A large space is formed in the rear of the inner oven 3. A space is also formed between the upper surface of the inner oven 3 and that of the outer oven 2 and between the lower surface of the inner oven 3 and that of the outer oven 2. A plurality of holes 4 for introducing atmospheric gas are formed at regular intervals on the upper and lower surfaces of the inner oven 3.

A conveyor 6 for transporting a circuit substrate 5 by supporting both side edges thereof is disposed in the vertical center of the inner oven 3 and extends through each of a number of chambers described later. Observing windows 7, consisting of transparent glass, are formed in the front wall of the outer oven 2 and the inner oven 3, respectively.

There is provided an opening 8 on the rear wall of the outer oven 2 for supplying nitrogen gas to be used to provide an inactive atmosphere in the oven 1. Gas supply fans 9 are in a rear portion inside the outer oven 2 for supplying the nitrogen gas introduced through the opening 8 to the space disposed between the upper surface of the inner oven 3 and that of the outer oven 2 and the space disposed between the lower surface of the inner oven 3 and that of the outer oven 2. Heaters 10 are disposed adjacently to each gas-feeding fan 9 for heating the nitrogen gas to a predetermined temperature.

Referring to FIGS. 1 and 2, the outer oven 2 is longitudinally partitioned by a partitioning wall 14 into a preheating chamber 11, a fellow heating chamber 12 and a slow-cooling chamber 13. Each chamber accommodates the gas supplying opening 8, the gas-feeding fans 9, and the heaters 10 so as to control its temperature. The inner oven 3 accommodates partitioning plates 15 corresponding to the partitioning walls 14 as necessary. Each partitioning plate 15 has an opening 15*a* for allowing the conveyor 6 and the substrate 5 to pass therethrough.

Both longitudinal ends of the outer oven 2 and those of the inner oven 3 are closed, and an entrance 16 and an exit 17 are formed at the ends of the inner oven 3 so that the conveyor 6 disposed inside the inner oven 3 and the substrate 5 placed thereon pass therethrough. There are provided cylindrical portions 18 each projecting outward a certain length from the entrance 16 and the exit 17. Each cylindrical portion 18 has a function of preventing the nitrogen gas in the oven 1 from flowing outside in the largest amount possible while the substrate 5 placed on the conveyor 6 is passing through the entrance 16 or the exit 17.

In each of the preheating chamber 11, the reflow heating chamber 12, and the slow-cooling chamber 13 of the reflow oven 1 of the above-described construction, nitrogen gas supplied from the opening 8 to the rear portion inside the outer oven 2 is fed by the gas-feeding fans 9 to the upper and lower spaces of the inner oven 3 while it is heated to the predetermined temperature by each heater 10. Then, the nitrogen gas fed to the upper and lower spaces of the inner oven 3 uniformly blows into the inner oven 3 through the holes 4 formed on the upper and lower walls of the inner oven 3. As a result, the region of the inner oven 3 corresponding to each of the preheating chamber 11, the reflow heating chamber 12, and the slow-cooling chamber 13 are uniformly heated to the predetermined temperature, respectively.

While the substrate 5 which has been transported into the outer oven 2 through the entrance 16 is passing through the inner oven 3, the substrate 5 is preheated to 120° to 150° C. in the region corresponding to the preheating chamber 11 and heated to 180° to 210° C. in the region corresponding to the reflow heating chamber 12. As a result, cream solder is melted and electronic components are soldered onto the substrate 5. Thereafter, the substrate 5 is cooled slowly in the region corresponding to the slow-cooling chamber 13 and then discharged from the exit 17.

According to the oven having the above-described construction, the nitrogen gas fed by the fans 9 from the rear portion of the outer oven 2 and heated by the heaters 10 is introduced into the inner oven 3 through the holes 4. Thus, the substrate 5 can be uniformly heated even though the height of the inner oven 3 is reduced to the minimum in transporting the substrate 5. Consequently, an inner oven 3 of a very small volume can be used.

In addition, since the fans 9 and the heaters 10 are disposed in the rear portion of the outer oven 2, it is only necessary that the spaces for allowing the passage of the nitrogen gas are provided between the outer oven 2 and the inner oven 3. Therefore, the outer oven 2 is small in its capacity and simple in its configuration, for example, sectionally rectangular and tunnel-shaped throughout its entire length.

The outer oven 2 has a small volume and a reliable gas-sealing performance, although it is simple in its construction. Consequently, nitrogen gas is consumed in a small amount and the running cost is low, and moreover, the nitrogen gas in the oven is kept at an approximately constant purity.

Further, the cylindrical portions 18, each disposed at the entrance 16 and the exit 17 of the oven 1, are capable of effectively preventing nitrogen gas from flowing outside in the largest amount possible. Therefore, nitrogen gas is consumed in a small amount.

In the first embodiment, the substrate 5 is heated by the atmospheric gas heated by the heaters 10. But as shown by imaginary lines in FIG. 1, far infrared heaters 10*a* may be provided on the inner surface of the upper and lower walls of the inner oven 3 in combination with heated gas blown against the substrate 5.

In the first embodiment, the heaters 10 are disposed in the vicinity of the fans 9 on the downstream side thereof, but the heaters 10 may be placed at desired positions inside the outer oven 2. In addition, the substrate 5 may be heated by a heater outside the outer oven 2 before it is supplied to the outer oven 2.

Figure 3:
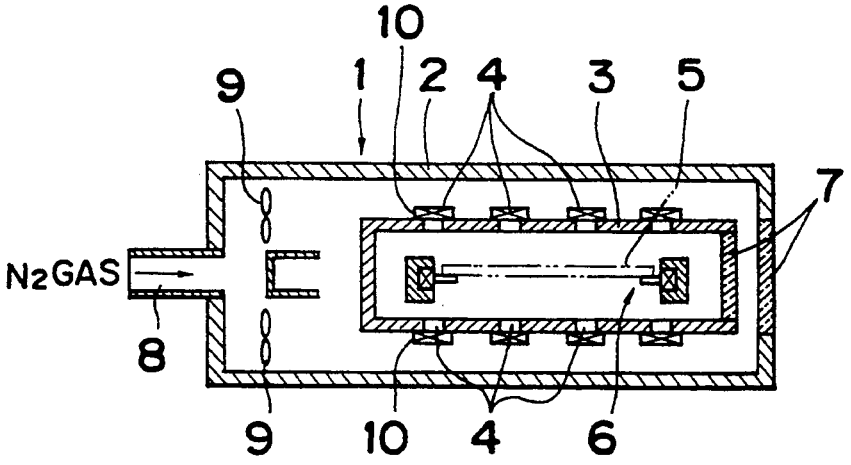
FIG. 3 is a cross-sectional view showing a reflow oven according to a modification of the first embodiment.

Furthermore, as shown in FIG. 3, the heaters 10 may be disposed in contact with the outer wall of the inner oven 3 or installed inside the upper and lower wall thereof.

The oven according to the first embodiment comprises the outer oven and the inner oven. Atmospheric gas fed from one side of the outer oven is introduced into the inner oven through a plurality of the holes formed on the upper and lower walls of the inner oven. Thus, the substrate can be uniformly heated even though the capacity of the inner oven is reduced to a minimum in view of the size of the substrate. In addition, since the means for supplying atmospheric gas to the outer oven and the gas-feeding fan are provided on one side of the outer oven, it is only necessary that the spaces for allowing the passage of the atmospheric gas are secured between the outer oven and the inner oven. Therefore, an outer oven of a small capacity can be used, and consequently nitrogen gas is consumed in a small amount, and as such the running cost is low. Further, since the oven has simple construction, the outer oven can accomplish a reliable gas-sealing performance and accordingly keep nitrogen gas at an approximately constant purity.

Referring to FIGS. 4 through 7, a fellow oven according to a second embodiment of the present invention will be described below.

Figure 4:
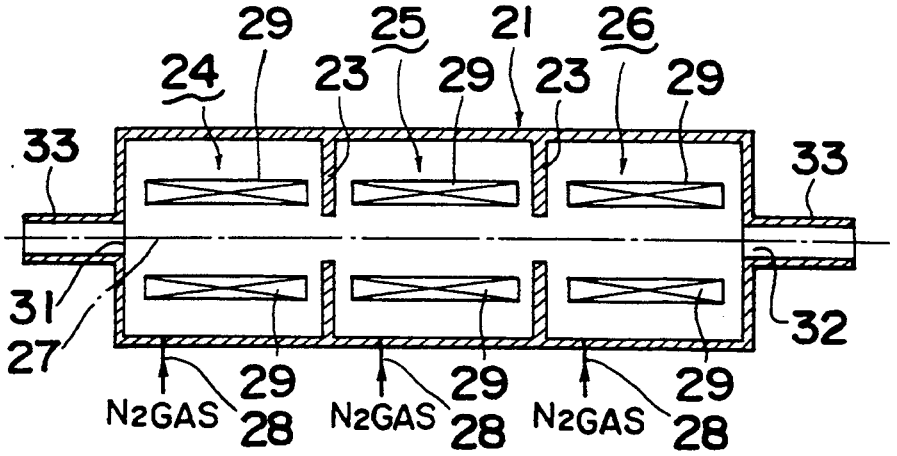
FIG. 4 is a vertical sectional view showing a schematic construction of an entire reflow oven according to a second embodiment of the present invention.

Referring to FIG. 4, a tunnel-shaped main body 22 of a fellow oven 21 is longitudinally partitioned by partitioning walls 23 into a preheating chamber 24, a fellow heating chamber 25, and a slow-cooling chamber 26. A chain conveyor 27 for transporting a circuit substrate 30 by supporting both side edges thereof is disposed in the middle portion of each chamber in the vertical direction thereof and extends through each chamber. Each chamber is provided with a nitrogen gas introducing means 28 on the lower wall thereof and heaters 29 for controlling the temperature of each chamber disposed above and below the chain conveyor 27. The heaters 29 uniformly heat the substrate 30 placed on the chain conveyor 27 a nitrogen gas atmosphere. Both longitudinal ends of the main body 22 are closed, and an entrance 31 and an exit 32 are formed at the ends thereof so that the conveyor 27 passes therethrough. There are provided cylindrical portions 33 each projecting outward in a certain length from the entrance 31 and the exit 32. The cylindrical portions 33 have a function of preventing the nitrogen gas from flowing outside to the largest degree possible. Each of the cylindrical portions 33 has the smallest sectional area possible able to pass therethrough the chain conveyor 27 and the substrate 30 placed thereon so that the cylindrical portions 33 prevent the nitrogen gas from flowing outside to the largest degree possible. Preferably, the length of the cylindrical portions 33 is more than or equal to twice the height thereof. More preferably, the length of the cylindrical portions 33 is more than or equal to three to five times the height thereof so as to effectively prevent the nitrogen gas from flowing outside without a large installation space.

Figure 5:
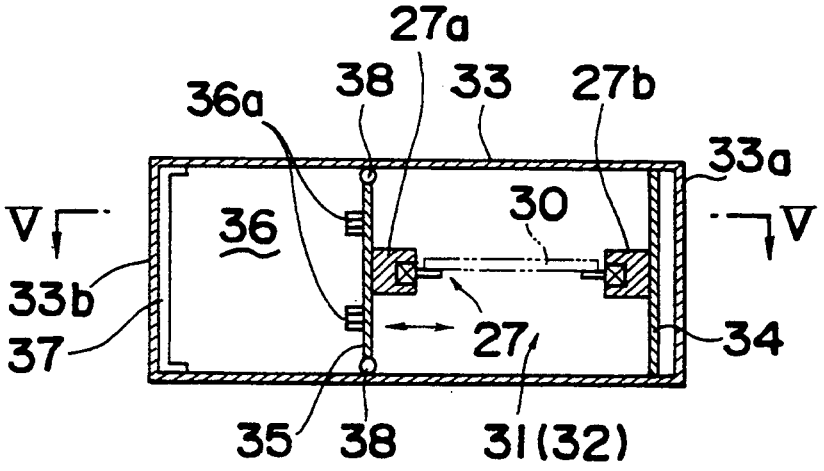
FIG. 5 is a cross-sectional view showing an entrance of the reflow oven and an exit thereof according to the second embodiment of the present invention.
Figure 6:
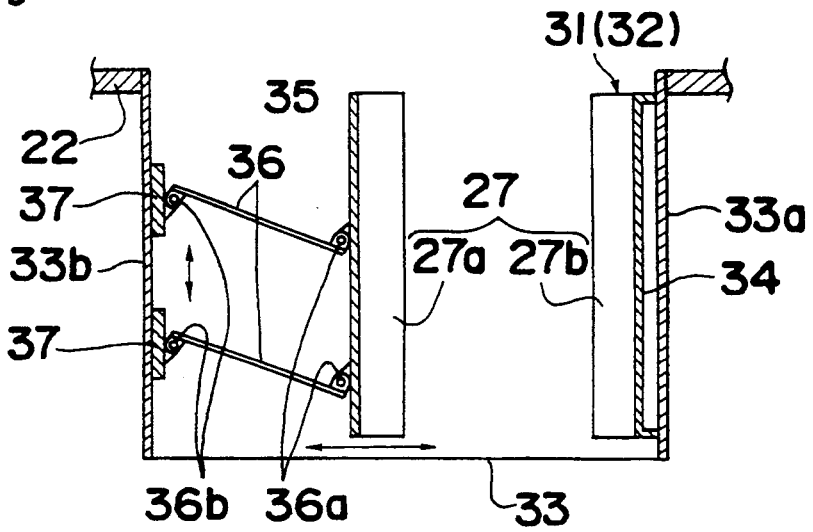
FIG. 6 is a sectional view taken along a line V—V of FIG. 5.

As shown in FIGS. 5 and 6, each cylindrical portion 33 accommodates a fixed wall 34 disposed in the vicinity of one side wall 33*a* thereof and a partitioning wall 35 slidable with respect to the fixed wall 34. A pair of chain guides 27*a* and 27*b* opposed to each other and composing the chain conveyor 27 are installed at the middle portions of the partitioning wall 35 and the fixed wall 34 in the vertical direction. A pair of sealing members 36 for sealing the gap between the partitioning wall 35 and the other wall 33*b* of the cylindrical portions 33 are disposed therebetween. One end of the sealing members 36 is pivotally mounted on the partitioning wall 35 by means of hinges 36*a* and the other end thereof is also pivotally mounted by means of hinges 36*b* on a slide member 37 slidable along the other wall 33*b*. The position adjustment of the partitioning wall 35 can be adjusted by the position adjustment of the slide member 37. A rubber member 38 or a roller is installed on the upper and lower ends of the partitioning wall 35 so that the rubber member 38 slides smoothly in a horizontal direction.

Each of the preheating chamber 24, the fellow heating chamber 25, and the slow-cooling chamber 26 of the reflow oven 21 of the above-described construction is maintained in an inactive atmosphere by nitrogen gas supplied thereto from each gas-introducing means 28, and the substrate 30 supplied by the chain conveyor 27 from the entrance 31 is uniformly heated to a predetermined temperature in each of the preheating chamber 24 and the reflow heating chamber 25 by the heaters 29. While the substrate 30 is passing through the main body 22, the substrate 30 is preheated to 120° to 150° C. in the preheating chamber 24 180° to 210° C. in the fellow heating chamber 25. As a result, cream solder is melted and electronic components are soldered onto the substrate 30. Thereafter, the substrate 30 is cooled slowly in the region corresponding to the slow-cooling chamber 26 and then discharged from the exit 32.

According to the main body 22 having the above-described construction, there are provided at the entrance 31 and the exit 32 the cylindrical portions 33 of the predetermined length, having the smallest sectional areas possible able to pass therethrough the chain conveyor 27 and the substrate 30 placed thereon. Therefore, nitrogen gas can be prevented from flowing outside to the largest degree possible, and the atmosphere of the main body 22 can be maintained with a simple construction and the use of a small amount of nitrogen gas.

In particular, the partitioning wall 35 and the sealing member 36 are arranged in the cylindrical portion 33. The position of the partitioning wall 35 can be adjusted horizontally according to the width of the substrate 30, and the sealing members 36 seal the gap between the partitioning wall 35 and one of the side walls of the cylindrical portion 33. In this manner, the out-flow of atmospheric gas can be effectively prevented.

In addition, the position of the partitioning wall 35 can be adjusted in unison with the alteration of the width between the chain guides 27*a* and 27*b* composing the chain conveyor 27 according to the width of the substrate 30, and thus the alteration can be easily performed.

Figure 7:
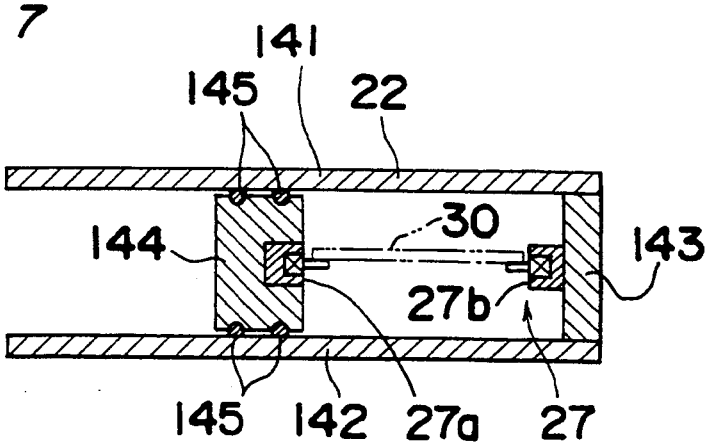
FIG. 7 is a cross-sectional view showing the schematic construction of a reflow oven according to a modification of the second embodiment.

In the second embodiment, the cylindrical portions 33 for preventing nitrogen gas from flowing outside to the largest amount possible are provided at the entrance 31 and the exit 32 in order to consume only a small amount of nitrogen gas. It is also possible to reduce the amount of consumption of nitrogen gas by varying the capacity of the main body 22 according to the width of the substrate 30, as shown in FIG. 7. A wall 143 of the main body 22 is fixed to one end of an upper wall 141 and a lower wall 142 while the other wall 144 of the main body 22 is slidable along the upper wall 141 and the lower wall 142 so that the distance between the walls 143 and 144 can be adjusted according to the width of the substrate 30. There are provided sealing members 145, composed of tetrafluoride resin, heat-resistant and small in frictional resistance, in the sliding portion between the upper surface of the wall 144 and the inner surface of the upper wall 141 and between the lower surface of the wall 144 and the inner surface of the lower wall 142. A pair of the chain guides 27*a* and 27*b* opposed to each other and constituting the chain conveyor 27 are installed in the center of the wall 143 and the wall 144 in the vertical direction thereof.

According to this construction, the width of the chain conveyer 27 can be adjusted and the inner width of the main body 22, namely, the volume thereof can be varied by adjusting the position of the wall 144 according to the width of the substrate 30. In this manner, nitrogen gas can be consumed in a small amount according to the width of the substrate 30.

Figure 8:
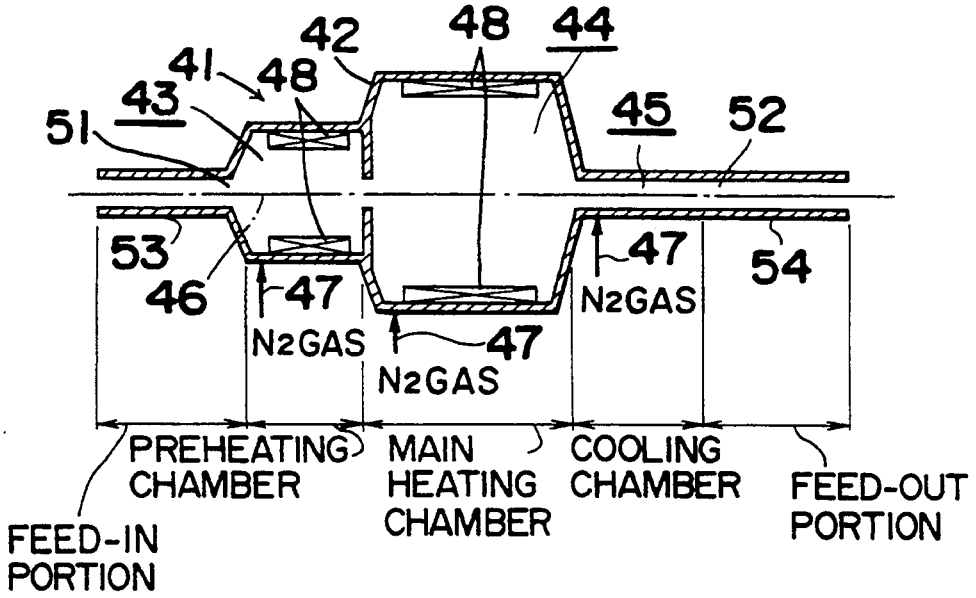
FIG. 8 is a vertical sectional view showing the schematic construction of a reflow oven according to a third embodiment of the present invention.

Referring to FIG. 8, a reflow oven according to a third embodiment of the present invention will be described below.

A fellow oven 41 comprises a tunnel-shaped main body 42 having a constant width and different heights. An oven main body 42 is longitudinally partitioned into a preheating chamber 43, a main heating chamber 44 and a cooling chamber 45 of different heights. A conveyor 46 for transporting a substrate by supporting both side edges thereof is disposed in the center of each chamber in the vertical direction thereof and extends through each chamber. Each chamber is provided with a nitrogen gas-introducing means 47, and the preheating chamber 43 and the main heating chamber 44 are provided with heaters 48 for controlling the temperature thereof, disposed above and below the conveyor 46. The heaters 48 uniformly heat the substrate placed on the conveyor 46 in a nitrogen gas atmosphere.

Both ends of the main body 42 are closed, and an entrance 51 and an exit 52 are formed at the ends thereof so that the conveyor 46 and the substrate pass therethrough. There are provided a feed-in portion 53 and a feed-out portion 54 each projecting outward a certain length from the entrance 51 and the exit 52, respectively. The feed-in portion 53 and the feed-out portion 54 each comprise a cylindrical portion having the smallest sectional area possible able to pass therethrough the conveyor 46 and the substrate placed thereon so as to prevent nitrogen gas from flowing outside to the largest degree. Preferably, the length of each cylindrical portion is more than equal to or twice the height thereof. More preferably, the length of each cylindrical portion is more than equal to or three to five times the height thereof so that the nitrogen gas can be effectively prevented from flowing outside without using a large space.

The main heating chamber 44, in which an atmospheric temperature is highest, is higher than the preheating chamber 43 and the cooling chamber 45 so as to secure a sufficient interval between the heaters 48 and the substrate placed on the conveyor 46. The preheating chamber 43 is lower than the main heating chamber 44, but higher than the cooling chamber 45. More specifically, supposing that the height of the heating chamber 44 is 1, the height of the preheating chamber 43 is set as 0.7 to 0.5; the cooling chamber 45 is set as 0.5 to 0.2, and the feed-in portion 43 and the feed-out portion 54 are set as 0.5 to 0.1.

In the reflow oven 41 of the above-described construction, each of the preheating chamber 43, the main heating chamber 44, and the cooling chamber 45 is maintained in an inactive atmosphere by nitrogen gas supplied thereto by each gas-introducing means 47, and the substrate supplied by the conveyor 46 from the entrance 51 to the preheating chamber 43 through the feed-in portion 53 is heated by the heaters 48 to a predetermined temperature in each of the preheating chamber 43 and the main heating chamber 44 while passing therethrough. The predetermined interval is secured between the heaters 48 and the substrate according to the heating temperature of each heater 48. Accordingly, while the substrate is being heated, it is uniformly heated and the surface thereof is not damaged. While the substrate is passing through the main body 42, the substrate is preheated to 120° to 150° C. in the preheating chamber 44 and to 180° to 210° C. in the main heating chamber 44. As a result, cream solder is melted and electronic components are soldered onto the substrate. Thereafter, the substrate is cooled slowly in the cooling chamber 45 and then discharged from the feed-out portion 54 through the exit 52.

In addition, since the preheating chamber 43 and the cooling chamber 45 are lower than the main heating chamber 44, the volume of the main body 42 is small, and therefore, the amount of consumption of nitrogen gas is small and the running cost is low. There are provided at the entrance 51 and the exit 52 the feed-in portion 53 and the feed-out portion 54, respectively, having a predetermined length, and having the smallest sectional areas possible able to pass therethrough the conveyor 46 and the substrate placed thereon. Therefore, the oven 41 can prevent nitrogen gas from flowing outside and maintain the atmosphere of the main body 42 with a simple construction, although the amount of consumption of nitrogen gas is small.

According to the atmospheric oven of the third embodiment, the height of each chamber is differentiated from the other chambers according to the temperature of the atmospheric gas. That is, the height of the chamber in which a low atmospheric temperature is required is smaller than the other chambers. Thus, an oven of a small volume can be used, and the atmospheric gas is consumed only in a small amount.

There are provided the cylindrical feed-in portion and the feed-out portion extending a certain length from the entrance of the oven and the exit thereof and having the smelliest sectional area possible able to pass therethrough the conveyor and the substrate placed thereon. Therefore, simple in its construction, the oven can prevent nitrogen gas from flowing outside to the largest degree possible, and as such consumes a small amount of the atmospheric gas.

Figure 9:
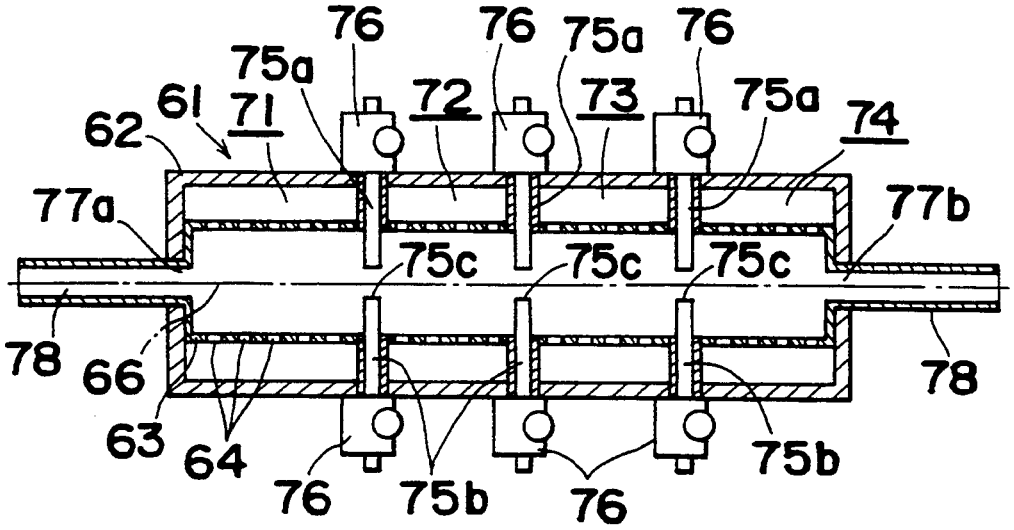
FIG. 9 is a vertical sectional view showing a reflow oven according to a fourth embodiment of the present invention.
Figure 10:
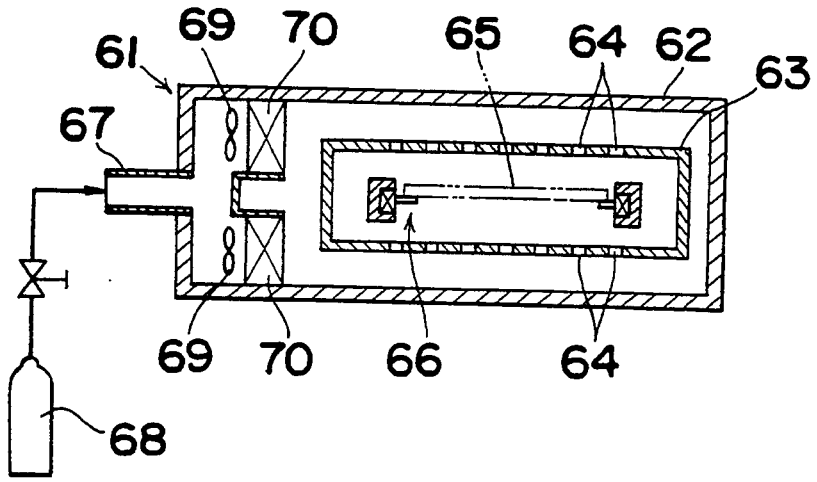
FIG. 10 is a cross-sectional view of the reflow oven of FIG. 9.
Figure 11:
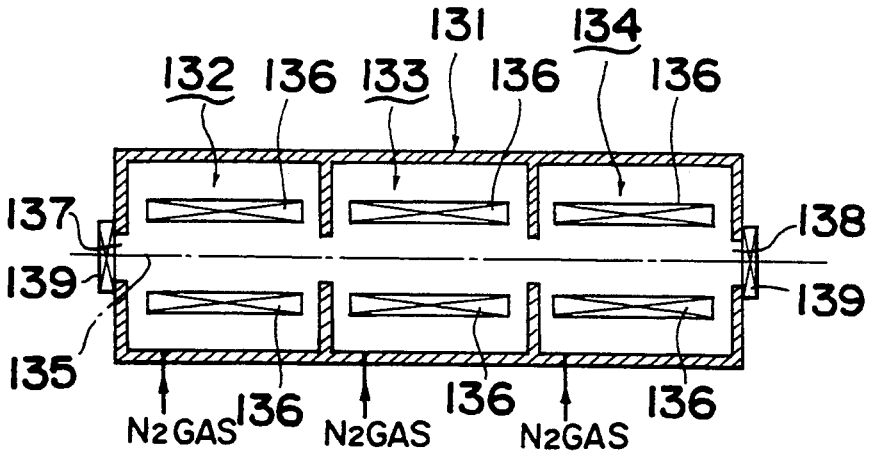
Fig. 11 PRIOR ART
FIG. 11 is a vertical sectional view showing the schematic construction of a conventional reflow oven.
Figure 12:
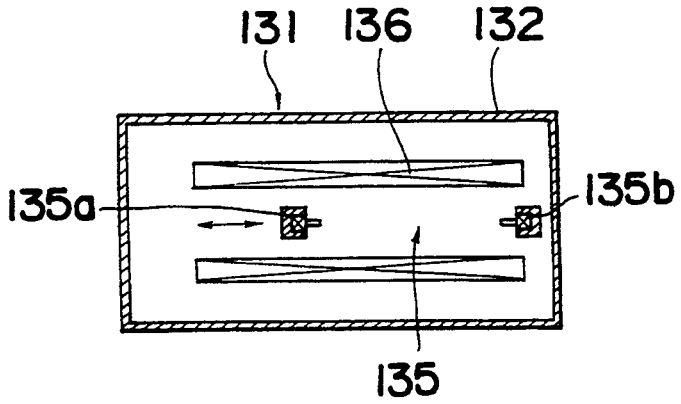
Fig. 12 PRIOR ART
FIG. 12 is a cross-sectional view showing the reflow oven of FIG. 11.

Referring to FIGS. 9 and 10, a reflow oven according to a fourth embodiment of the present invention will be described below.

A reflow oven 61 comprises an outer oven 62 that is sectionally rectangular and tunnel-shaped and an inner oven 63 having the same configuration as the outer oven 62 disposed inside the outer oven 62 and extending laterally over the whole length of the outer oven 62. The inner oven 63 is disposed from approximately the middle of the outer oven 62 to the forward portion thereof such that it is provided only on one side thereof. A large space is formed in the rear of the inner oven 63. A large space is also formed between the upper surface of the inner oven 63 and that of the outer oven 62 and between the lower surface of the inner oven 63 and that of the outer oven 62. A plurality of holes 64 for introducing atmospheric gas are formed at regular intervals on the upper surface of the inner oven and the lower surface thereof. A conveyor 66 for transporting a substrate 65 by supporting both side edges thereof is disposed in the center of the inner oven 63 in the vertical direction thereof and is extended through each of the chambers described below.

There is provided on the rear wall of the outer oven 62 an opening 67 for supplying nitrogen gas to the oven 61 so as to provide an inactive atmosphere inside the oven 61. The opening 67 is connected with a nitrogen gas canister 68. There are provided, in the rear portion inside the outer oven 62, gas-feeding fans 69 for supplying nitrogen gas introduced from the opening 67 to the space disposed between the upper surface of the inner oven 63 and that of the outer oven 62 and the space disposed between the lower surface of the inner oven 63 and that of the outer oven 62. Heaters 70 are disposed adjacent to each gas-feeding fan 69 for heating the nitrogen gas to a predetermined temperature.

Referring to FIG. 9, the outer oven 62 is longitudinally partitioned by plural pairs of upper and lower partitioning walls 75*a* and 75*b* into a first preheating chamber 71, a second preheating chamber 72, a reflow heating chamber 73 and a slow-cooling chamber 74. A part of each of the partitioning walls 75*a* and 75*b* projects into the inner oven 63 through the upper and lower walls of the inner oven 63, thus forming openings 75*c* for allowing the passage of the conveyor 66 and the substrate 65 placed thereon. The projecting portion of each of the partitioning walls 75*a* and 75*b*, corresponding to the upper and lower walls of the inner oven 63, is movably supported in a vertical direction thereof by an elevating means 76, such as a motor with a rack and pinion, and the interval between the upper and lower walls of the inner oven 63 can be varied by the elevating means 76 according to the size of the substrate 65. Each chamber accommodates the gas supply opening 67, the gas-feeding fans 9, and the heaters 70 so as to control the temperature thereof.

Both longitudinal ends of the outer oven 62 and those of the inner oven 63 are closed, and an entrance 77*a* and an exit 77*b* are formed at the ends of the outer oven 62 and that of the inner oven 63 so that the conveyor 66 disposed inside the inner oven 63 and the substrate 65 placed thereon pass therethrough. There are provided cylindrical portions 78, of a certain length, each projecting outward a certain length from the entrance 77*a* and the exit 77*b*. The cylindrical portions 78 prevent the nitrogen gas from flowing outside to the largest degree possible when the substrate 65 placed on the conveyor 66 is passing through the entrance 77*a* and the exit 77*b*.

In each of the first preheating chamber 71, the second preheating chamber 72, the reflow heating chamber 73, and the slow-cooling chamber 74 of the reflow oven 61 of the above-described construction, nitrogen gas supplied from the opening 67 to the rear portion inside the outer oven 62 is fed by the gas-feeding fans 69 toward the upper and lower spaces of the inner oven 63 and heated to the predetermined temperature by each heater 70. Then the nitrogen gas uniformly blows into the inner oven 63 through the gas-introducing holes 44 formed on the upper and lower walls of the inner oven 63. As a result, the region corresponding to each of the first preheating chamber 71, the second preheating chamber 72, the reflow heating chamber 73, and the slow-cooling chamber 74 are uniformly heated to a predetermined temperature, respectively.

While the substrate 65 which has been transported into the inner oven 63 from the entrance 77*a* is passing therethrough, the substrate 65 is preheated to 100° to 120° C. in the region corresponding to the first preheating chamber 71, 140° to 160° C. in the region corresponding to the second preheating chamber 72, and 180° to 210° C. in the region corresponding to the fellow heating chamber 73. As a result, cream solder is melted and electronic components are soldered onto the substrate 65. Thereafter, the substrate 65 is cooled slowly in the region corresponding to the slow-cooling chamber 74 and then discharged from the exit 77*b*.

In passing the substrate 65 through the openings 75*c* between the upper and lower partitioning walls 75*a* and 75*b*, the vertical distance of the opening 75*c* can be reduced to the smallest degree possible by the elevating means 76 according to the size of the substrate 65. In this manner, nitrogen gas can be prevented from flowing outside to the largest degree possible and consumed in a small amount. In addition, the atmospheres can be prevented from interfering with each other between the chambers 71, 72, 73, and 74 to the largest degree possible. Thus, a desired temperature profile can be easily set.

According to the oven having the above-described construction, nitrogen gas fed by the fans 69 from the rear of the outer oven 62 and heated by the heaters 70 is introduced into the inner oven 63 through the gas-introducing holes 64. Thus, the substrate 65 can be uniformly heated even though the height of the inner oven 63 is reduced to the minimum in transporting the substrate 65, and the volume of the inner oven 63 can be made to be small.

In addition, since the fans 69 and the heaters 70 are disposed in the rear portion of the outer oven 62, it is only necessary that a space is provided between the upper surface of the outer oven 62 and that of the inner oven 63 and between the lower surface of the outer oven 62 and that of the inner oven 63 so that atmospheric gas is supplied therebetween. Therefore, the outer oven 62 is made to be small in its capacity and simple in its configuration, for example sectionally rectangular and tunnel-shaped throughout its entire length.

Simple in its construction, the outer oven 2 has a small volume and a reliable gas-sealing performance. Consequently, nitrogen gas is consumed in a small amount and the running cost is low, and, moreover, the nitrogen gas in the oven is kept at an approximately constant purity.

Further, the cylindrical portions 78 disposed at the entrance 77*a* and the exit 77*b* of the oven 61 are capable of effectively preventing nitrogen gas from flowing outside. Therefore, the nitrogen gas is consumed in a small amount.

The heater 70 can be disposed at a desired position in the outer oven 62. The substrate 65 may be heated outside the outer oven 61 by a heater before it is supplied to the outer oven 62. In addition, the heater 70 may be disposed in contact with the outer wall of the inner oven 63 or incorporated in the upper and lower walls of the inner oven 63. Further, in order to heat the substrate 65, a far infrared heater may be provided on the upper and lower surfaces of the inner oven 3 in combination with heated gas blown against the substrate 65.

According to the oven of the fourth embodiment, the oven 61 comprises the outer oven 62 and the inner oven 63. But the present invention may be applied to a conventional tunnel-shaped oven. In the fourth embodiment, the upper and lower partitioning walls 75*a* and 75*b* are vertically movable, but only the upper partitioning wall 75*a* may be vertically movable in view of the fact that electronic components mounted on the substrate 65 do not project below the conveyor 66.

According to the oven of the fourth embodiment, the interval between the upper partitioning wall and the lower partitioning wall can be reduced to the smallest degree possible according to the size of the substrate by moving both partitioning walls or only the upper partitioning wall. In this manner, atmospheric gas can be prevented from flowing outside to the largest degree possible and consumed in a small amount. In addition, the atmospheric gases of the chambers can be prevented to the greatest degree possible from interfering with each other. Thus, each chamber is capable of easily obtaining a different predetermined temperature. Thus, a desired temperature profile can be easily set.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. An atmospheric oven, comprising:

an oven body containing atmospheric gas maintained at a predetermined purity, accommodating a transport therein for transporting an object to be heated along a predetermined transport path, and having an oven entrance and an oven exit;

passage walls defining passages extending a certain length from said oven entrance and said oven exit of said oven body for preventing the atmospheric gas from flowing out of said oven body, each said passage having a sectional area smaller than the sectional area of said oven body, and each said passage having a partition wall therein that is positionally adjustable according to the width of an object to be transported therethrough, said partition wall forming a gap with one of said passage walls; and a sealing member for sealing said gap between said partition wall and the one said passage wall of each said passage.

2. The atmospheric oven of claim 1, and further comprising means for adjusting the position of said partition wall while simultaneously altering the width of said transport.

3. The atmospheric oven of claim 1, wherein said oven body has an interior divided into a plurality of chambers along said transport path, each said chamber having an atmosphere heated to a different temperature.

4. The atmospheric oven of claim 1, wherein said sealing member has one end hingedly connected to said partition wall and an opposite end connected to a slide member sliding on the one said passage wall.

5. The atmospheric oven of claim 1, wherein said transport includes one portion on said partition wall and another portion on another said passage wall.

* * * * *